US009750117B2

(12) United States Patent
Nanahara et al.

(10) Patent No.: US 9,750,117 B2
(45) Date of Patent: Aug. 29, 2017

(54) LIGHTING SYSTEM, LIGHTING DEVICE, AND METHOD OF COMMUNICATION IN LIGHTING SYSTEM

(71) Applicant: PANASONIC INTELLECTUAL PROPERTY MANAGEMENT CO., LTD., Osaka (JP)

(72) Inventors: Atsuo Nanahara, Kyoto (JP); Shigeo Gotoh, Osaka (JP); Tamotsu Ando, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/157,282

(22) Filed: May 17, 2016

(65) Prior Publication Data

US 2016/0353558 A1 Dec. 1, 2016

(30) Foreign Application Priority Data

Jun. 1, 2015 (JP) ..... 2015-111419

(51) Int. Cl.
*H05B 37/02* (2006.01)
*G08C 17/02* (2006.01)

(52) U.S. Cl.
CPC ..... *H05B 37/0272* (2013.01); *G08C 17/02* (2013.01); *H05B 37/0281* (2013.01)

(58) Field of Classification Search
CPC .... H05B 37/00; H05B 37/02; H05B 37/0245; H05B 37/0272; H05B 37/0281; G08C 17/02
See application file for complete search history.

(56) References Cited

U.S. PATENT DOCUMENTS 6,404,079 B1 * 6/2002 Hsieh ..... F21V 23/04 307/116
6,538,568 B2 * 3/2003 Conley, III ..... G08B 7/062 315/86
8,816,602 B2 * 8/2014 Van Doorn ..... H05B 33/0803 315/155

(Continued)

FOREIGN PATENT DOCUMENTS

JP 2001-085168 A 3/2001
JP 2002-260875 A 9/2002

(Continued)

*Primary Examiner* — Thai Pham

(74) *Attorney, Agent, or Firm* — McDermott Will & Emery LLP

(57) ABSTRACT

A lighting system includes: a radio remote controller including a command transmitter which transmits a command; a relay including a relay receiver which receives the command and a relay transmitter which wirelessly transmits the command received by the relay receiver; and a lighting device including a command receiver, a storage, and a control circuit which (a) controls a light source according to the instruction included in a received command and stores a command number included in the received command in the storage, if the command number included in the received command does not match a command number stored in the storage, and (b) discards the received command if the command number included in the received command matches the command number stored in the storage.

7 Claims, 7 Drawing Sheets

(56) References Cited

U.S. PATENT DOCUMENTS

| | | | | |
|---|---|---|---|---|
| 9,066,393 | B2 * | 6/2015 | Recker | H05B 33/0815 |
| 2015/0334811 | A1 * | 11/2015 | So | H05B 37/02 315/152 |

FOREIGN PATENT DOCUMENTS

| | | | | |
|---|---|---|---|---|
| JP | 2002-289369 | A | | 10/2002 |
| JP | 2003-111149 | A | | 4/2003 |
| JP | 2003-143669 | A | | 5/2003 |
| JP | 2003-151781 | A | | 5/2003 |
| JP | 2003-234197 | A | | 8/2003 |
| JP | 2004-259657 | A | | 9/2004 |
| JP | 2005-063859 | A | | 3/2005 |
| JP | 2005-243313 | A | | 9/2005 |
| JP | 2005243313 | A | * | 9/2005 |

* cited by examiner

LIGHTING SYSTEM, LIGHTING DEVICE, AND METHOD OF COMMUNICATION IN LIGHTING SYSTEM

CROSS REFERENCE TO RELATED APPLICATION

This application claims the benefit of priority of Japanese Patent Application Number 2015-111419 filed on Jun. 1, 2015, the entire content of which is hereby incorporated by reference.

BACKGROUND

1. Technical Field

The present disclosure relates to a lighting system including a radio remote controller, a relay, and a lighting device, and a method of communication in the lighting system.

2. Description of the Related Art

For example, Patent Literature (PTL) 1: Japanese Unexamined Patent Application Publication No. 2001-85168 discloses a configuration that a wireless switch transmits a wireless signal through the medium of a light beam, a relay receives the wireless signal transmitted and transmits the wireless signal to a wireless lighting receiver. According to this configuration, it is possible to cause a signal transmitted from the wireless switch to reach the wireless lighting receiver even when the wireless lighting receiver is disposed at a position distant from or invisible from the wireless switch.

SUMMARY

As in the above-described conventional technique, it is possible, by providing a relay between a controller which wirelessly transmits an instruction and a lighting device which is to be caused to operate according to the instruction, to improve the degree of freedom in arrangement of the lighting device while ensuring the reliability of lighting control using the controller.

In this case, however, two devices (i.e., the controller and the relay) each serve as a source of transmitting the instruction to the lighting device. Accordingly, the lighting device, for example, redundantly receives the same instruction from both the controller and the relay, possibly leading to performing an unnecessary process. In order to prevent performing such an unnecessary process, it is conceivable, for example, to arrange a controller, a relay, and a lighting device to allow the lighting device to receive an instruction only from the relay. However, this is not advisable from the perspective of, for example, the degree of freedom in the layout of the lighting system.

In view of the above-described conventional problem, an object of the present disclosure is to provide a lighting system which includes a radio remote controller, a relay, and a lighting device, and is capable of causing the lighting device to efficiently operate according to an instruction from the radio remote controller, and a method of communication in the lighting system.

In order to achieve the above-described object, a lighting system according to an aspect of the present disclosure is a lighting system including: a radio remote controller; a relay; and a lighting device including a light source, wherein the radio remote controller includes a command transmitter which wirelessly transmits a command that includes an instruction to the lighting device and a command identifier having a value varied every time one command is transmitted, the relay includes a relay receiver which receives the command and a relay transmitter which wirelessly transmits the command received by the relay receiver, and the lighting device includes a command receiver capable of receiving the command transmitted by each of the command transmitter and the relay transmitter, a storage, and a control circuit which (a) controls the light source according to the instruction included in a received command that is the command received by the command receiver and stores the command identifier included in the received command in the storage, if the command identifier included in the received command does not match a command identifier stored in the storage, and (b) discards the received command if the command identifier included in the received command matches the command identifier stored in the storage.

In addition, a lighting device according to an aspect of the present disclosure includes a light source; a command receiver for receiving a command from each of a radio remote controller which wirelessly transmits the command and a relay which receives and transmits the command; a storage; and a control circuit which (a) controls the light source according to an instruction included in a received command that is the command received by the command receiver and stores a command identifier included in the received command in the storage, if the command identifier included in the received command does not match a command identifier stored in the storage, and (b) discards the received command if the command identifier included in the received command matches the command identifier stored in the storage.

In addition, a method of communication according to an aspect of the present disclosure is a method of communication performed in a lighting system including a radio remote controller which wirelessly transmits a command, a relay, and a lighting device including a light source and a storage, the method including: transmitting, by the radio remote controller, the command that includes an instruction to the lighting device and a command identifier having a value varied every time one command is transmitted; wirelessly transmitting, by the relay, the command received; and by the lighting device, (i) receiving the command transmitted by one of the radio remote controller and the relay, (ii) controlling the light source according to the instruction included in a received command that is the command received and storing the command identifier included in the received command into the storage, if the command identifier included in the received command does not match a command identifier stored in the storage, and (iii) discarding the received command if the command identifier included in the received command matches the command identifier stored in the storage.

According to the lighting system and the method of communication according to the present disclosure, it is possible to cause the lighting device to efficiently operate according to an instruction from the radio remote controller. Moreover, the lighting device according to the present disclosure is capable of efficiently operating according to an instruction from the radio remote controller.

BRIEF DESCRIPTION OF DRAWINGS

The figures depict one or more implementations in accordance with the present teaching, by way of examples only, not by way of limitations. In the figures, like reference numerals refer to the same or similar elements.

DETAILED DESCRIPTION OF THE EMBODIMENTS

A lighting system according to an embodiment will be described below with reference to the drawings. It should be noted that the embodiment described below shows one specific example of the present disclosure. Thus, the numerical values, shapes, materials, structural components, the disposition and connection of the structural components, and others described in the following embodiment and its modifications are mere examples, and do not intend to limit the present disclosure. Furthermore, among the structural components in the following embodiment and its modifications, structural components not recited in the independent claims which indicate the broadest concepts of the present disclosure are described as arbitrary structural components.

In addition, each of the diagrams is a schematic diagram and thus is not necessarily strictly illustrated. In each of the diagrams, substantially the same structural components are assigned with the same reference signs, and there are instances where redundant descriptions are omitted or simplified.

The following describes a lighting system according to the embodiment of the present disclosure.

[Configuration Example of a Lighting System]

Figure 1:
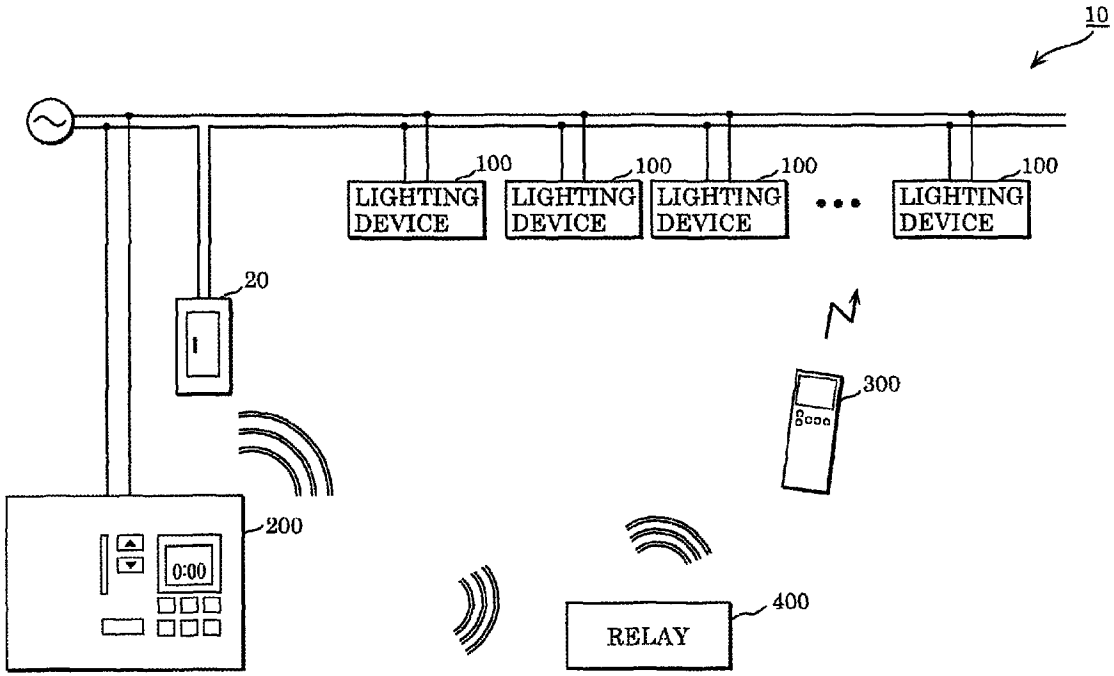
FIG. 1 is a diagram illustrating a schematic configuration of a lighting system according to an embodiment.

FIG. 1 is a diagram illustrating a schematic configuration of lighting system 10 according to an embodiment. Lighting system 10 according to the embodiment includes radio remote controller 200, lighting device 100, and relay 400. It should be noted that, in the embodiment, lighting system 10 includes a plurality of lighting devices 100 connected to power supply lines. Switch 20 switches between conduction and non-conduction of the power supply lines.

Turning on and off of lighting devices 100 are controlled by switch 20, and lighting devices 100 are further subject to control such as collectively changing brightness by an instruction from radio remote controller 200. In addition, lighting devices 100 each also correspond to infrared remote controller 300, allowing a user of infrared remote controller 300 to, for example, adjust brightness of lighting devices 100 individually.

Radio remote controller 200 is a remote controller which controls lighting devices 100 with a command transmitted wirelessly. Radio remote controller 200 includes various buttons for collectively adjusting brightness or the like of lighting devices 100, and a display for displaying a current dimming ratio, etc.

Infrared remote controller 300 is a remote controller which controls lighting devices 100 individually with a command transmitted using infrared light.

Relay 400 is a device which receives and transmits the command transmitted by radio remote controller 200. Relay 400 serves to, for example, cause the command transmitted by radio remote controller 200 to reach lighting device 100 disposed at a position which is difficult for the command to reach. In other words, relay 400 serves as an assisting communicator which assists command transmission from radio remote controller 200 to lighting devices 100. It should be noted that, although illustration is omitted in FIG. 1, relay 400 is also connected to a power supply line to receive power for operation.

The following describes a layout example, overview of functional configuration, and an operation example, of lighting system 10 having the above-described fundamental configuration.

[Layout Example of a Lighting System]

Figure 2:
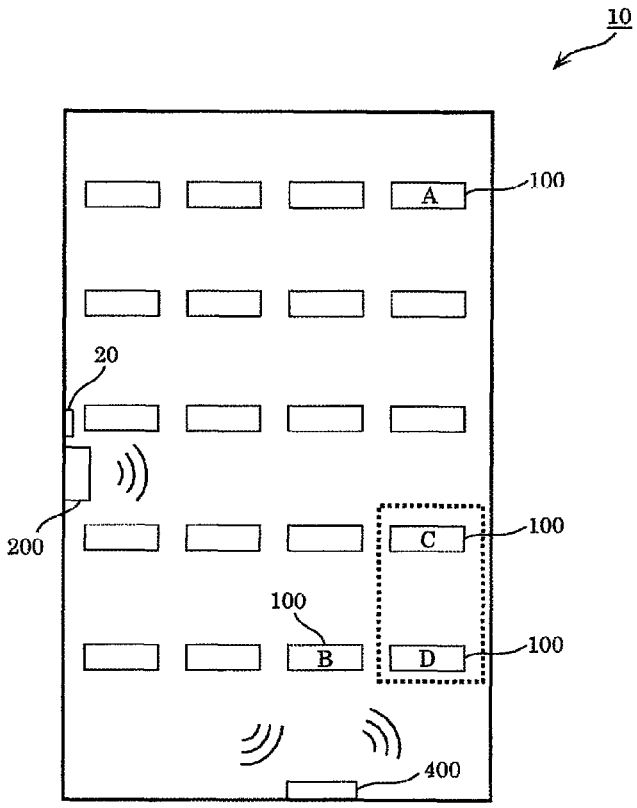
FIG. 2 is a plan view illustrating an example of a layout of the lighting system according to the embodiment.

FIG. 2 is a diagram illustrating a layout example of lighting system 10 according to the embodiment.

As illustrated in FIG. 2, a plurality of lighting devices 100 included in lighting system 10 are installed on a ceiling of a room which is a residential room, a store, or the like, and radio remote controller 200 and switch 20 are installed on a wall of the room, for example. It should be noted that FIG. 2 illustrates an example arrangement of the structural components such as lighting devices 100, when lighting system 10 is looked down from the ceiling side.

In the example illustrated in FIG. 2, twenty lighting devices 100 are arranged in a matrix, and all of the twenty lighting devices 100 are disposed in a range of radio waves which radio remote controller 200 transmits. In other words, in terms of the distance from radio remote controller 200, lighting devices 100 are each theoretically capable of receiving a command transmitted from radio remote controller 200. For example, in FIG. 2, lighting device 100 with reference sign "A" (hereinafter referred to as "lighting device A", the same holds true for other reference signs) which is disposed farthest from radio remote controller 200 is placed in a range in which a command from radio remote controller 200 can be received.

However, any of lighting devices 100 possibly fail to receive a command from radio remote controller 200 due to, for example, shielding of radio waves by furniture and fixtures, or interference between the radio waves from radio remote controller 200 and radio waves output from other communication devices.

In view of the above, relay 400 is disposed at a predetermined position distant from radio remote controller 200 and relays a command transmitted from radio remote controller 200, according to the embodiment. This decreases the possibility of failure in receiving a command by each of lighting devices 100.

For example, assume the case where lighting devices C and D enclosed by a dashed rectangle illustrated in FIG. 2 have difficulty in receiving a command transmitted by radio remote controller 200 due to furniture and fixtures disposed in a vicinity of lighting devices C and D.

In this case, relay 400 is disposed at a position relatively close to lighting devices C and D, thereby enabling each of lighting devices C and D to receive, via relay 400, the command transmitted by radio remote controller 200.

As described above, lighting system 10 according to the embodiment includes relay 400, thereby improving the reliability in transmitting information (instruction) from radio remote controller 200 to lighting devices 100. Moreover, for improving the reliability and allowing efficient operation of lighting devices 100, radio remote controller 200, etc., for example, have functional configurations described below.

[Configuration Example of the Lighting System]

Figure 3:
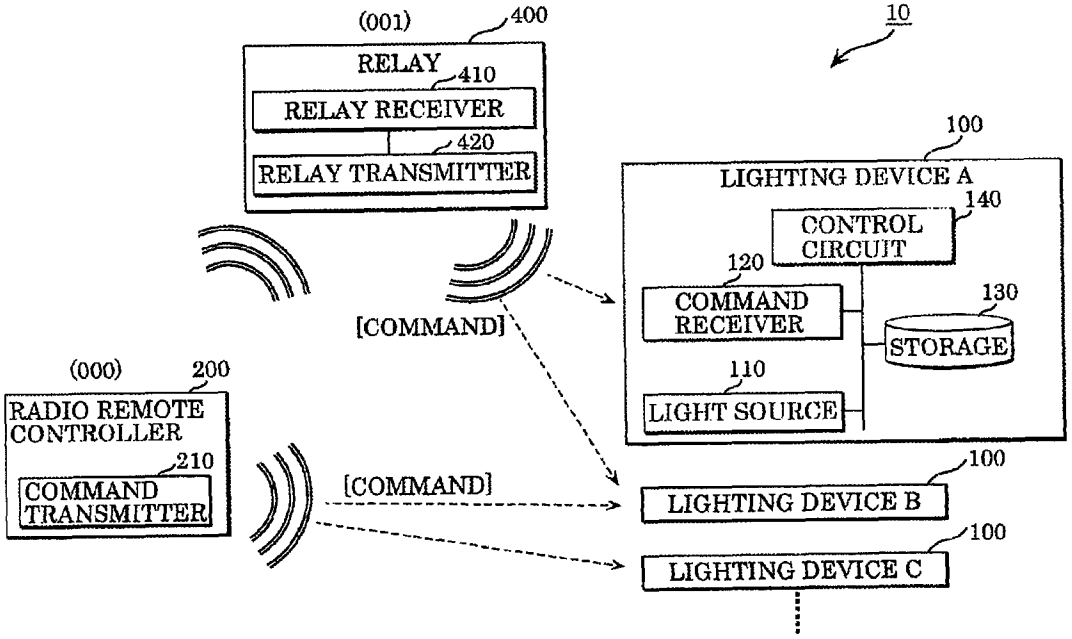
FIG. 3 is a diagram illustrating an example of a functional configuration of each of a radio remote controller, a relay, and a lighting device according to the embodiment.

FIG. 3 is a diagram illustrating an example of a functional configuration of each of radio remote controller 200, relay 400, and lighting devices 100 according to the embodiment.

As illustrated in FIG. 3, radio remote controller 200 includes command transmitter 210 which wirelessly transmits a command. The command transmitted by command transmitter 210 includes an instruction to lighting devices 100 and a command number that is a number having a value varied every time one command is transmitted. The command number is an example of the command identifier.

According to the embodiment, a plural number (twenty in the example of the embodiment) of lighting devices 100, when receiving a command, each performs an operation such as varying a dimming ratio according to the instruction included in the command. In other words, radio remote controller 200 is capable of collectively adjusting brightness, etc. of lighting devices 100 with the command transmitted by command transmitter 210.

In addition, according to the embodiment, command transmitter 210 generates a command number which is a serial number resulting from incrementing a value by one every time one command is transmitted. For example, a command transmitted first includes a command number "000", and a command transmitted next includes a command number "001". In addition, the command number is initialized when the command number is incremented up to "127", for example, and a command number "000" is assigned to a command transmitted next.

Relay 400 includes relay receiver 410 which receives a command and relay transmitter 420 which wirelessly transmits the command received by relay receiver 410. More specifically, relay 400 transmits from relay transmitter 420 the command received by relay receiver 410, without changing the instruction included in the command. In other words, relay 400 has a function of transferring a received instruction to at least one lighting device 100.

Each of lighting devices 100 includes light source 110, command receiver 120, storage 130, and control circuit 140.

Light source 110 is a device included in lighting device 100 as a light source for illumination. Light source 110 includes, for example, at least one light-emitting element. A light emitting diode (LED) is exemplified as the light-emitting element. It should be noted that the light-emitting element is not limited to the LED element, and light source 110 may include, for example, a semiconductor light-emitting element such as a semiconductor laser, or a solid-state light-emitting element such as an organic electro luminescence (EL) or an inorganic EL.

Command receiver 120 is capable of receiving a command transmitted from each of command transmitter 210 of radio remote controller 200 and relay transmitter 420 of relay 400.

More specifically, command receiver 120 has a function of directly receiving a command transmitted from radio remote controller 200 (hereinafter referred to as "direct receiving function") and a function of receiving via relay 400 a command transmitted from radio remote controller 200 (hereinafter referred to as "indirect receiving function").

Storage 130 is a non-volatile memory, for example. Control circuit 140 writes a command number included in a command onto storage 130, and reads a command number from storage 130.

Control circuit 140 controls light source 110 according to an instruction included in the command received by command receiver 120.

As described above, command receiver 120 has the direct receiving function and the indirect receiving function. For that reason, when a command including an instruction is transmitted by radio remote controller 200, command receiver 120 possibly receives redundantly the command indicating the instruction redundantly from both radio remote controller 200 and relay 400.

For example, lighting device B illustrated in FIG. 2 and FIG. 3 is disposed in a range of radio waves transmitted from radio remote controller 200 and at a position relatively close to relay 400. For that reason, when a command is transmitted by radio remote controller 200, command receiver 120 of lighting device B receives the command without involving relay 400, and also receives via relay 400. In this case, command receiver 120 redundantly receives the commands indicating the same instruction. Accordingly, if control circuit 140 operates according to the respective commands, an unnecessary process is meaninglessly carried out.

More specifically, with relay 400, although a command transmitted by radio remote controller 200 more reliably reaches lighting devices 100, there is a possible problem that an unnecessary process is performed by lighting device 100 which has redundantly received the command.

In view of the above, with lighting system 10 according to the embodiment, the number included in a command is varied every time one command is transmitted by radio remote controller 200, thereby allowing lighting devices 100 to avoid performing an unnecessary process when lighting devices 100 redundantly receives commands.

Specifically, control circuit 140 of lighting device 100 compares a command number included in a received command that is a command received by command receiver 120 and a command number stored in storage 130. If two command numbers do not match each other as a result of the comparing, control circuit 140 controls light source 110 according to an instruction included in the received command, and stores the command number included in the received command to storage 130. If the command number included in the received command matches the command number stored in storage 130 as a result of the comparing, control circuit 140 discards the received command. In other words, if the two command numbers match each other, control circuit 140 ignores the received command.

It should be noted that various functions of the structural components included in radio remote controller 200, relay 400, and lighting devices 100 (i.e., command transmitter 210, relay receiver 410, relay transmitter 420, command receiver 120, and control circuit 140) may be achieved by software stored on a memory, such as a program executed on a computer which includes, for instance, a central processing unit (CPU), random access memory (RAM), read only memory (ROM), a communication interface, an I/O port, and a hard disk, or may be achieved by hardware such as an integrated circuit, which are collectively referred to as an electronic circuit.

A specific example of operations of lighting system 10 having the configuration described above shall be given with reference to an example of data configuration of a command and a flowchart.

[Operation Example of the Lighting System]

Figure 4:
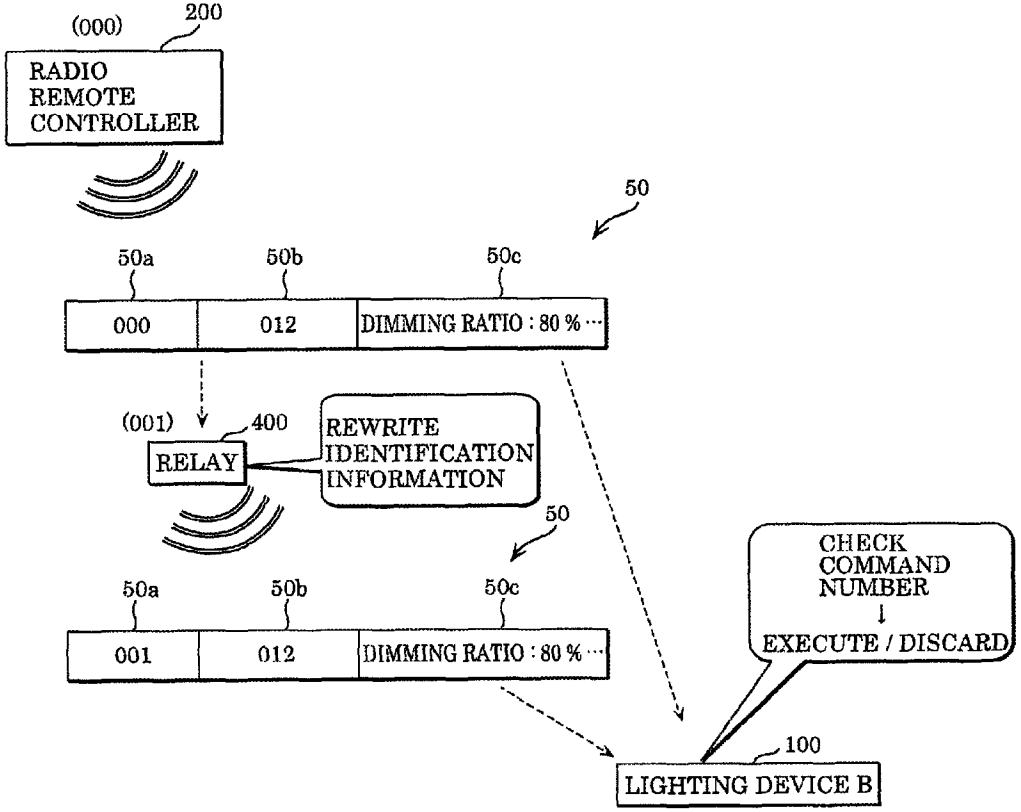
FIG. 4 is a diagram illustrating a data configuration example of a command in the lighting system according to the embodiment.

FIG. 4 is a diagram illustrating a data configuration example of a command in lighting system 10 according to the embodiment.

As illustrated in FIG. 4, assume the case where command 50 is transmitted by command transmitter 210 of radio remote controller 200. Command 50 includes command number 50*b* and instruction data 50*c*. In the example illustrated in FIG. 4, command number 50*b* indicates "012" and instruction data 50*c* includes an instruction to set a dimming ratio to 80% ("diming rate: 80%").

It should be noted that command number 50*b* is a data item indicating a numerical values ranging from "000" to "127", for example, and a data size of command number 50*b* is seven bits in this case. In contrast, instruction data 50*c* is a data item including the details of an instruction to lighting devices 100 (e.g., a type of control and a variable value necessary for control), and thus the data size of instruction data 50*c* is larger than the data size of command number 50*b*. More specifically, in the embodiment, the data size of a number (command number 50*b*) included in command 50 is smaller than the data size of an instruction (instruction data 50*c*) included in command 50.

In addition, according to the embodiment, command 50 includes identification information 50*a* for identifying a source of transmission. In the example illustrated in FIG. 4, command 50 includes, as identification information 50*a*, identifier "000" assigned to radio remote controller 200 that is the source of transmission. Command 50 described above is received by command receiver 120 of lighting device B.

Moreover, command 50 transmitted by radio remote controller 200 is also received by relay receiver 410 of relay 400, and transmitted by relay transmitter 420. More specifically, relay transmitter 420 rewrites identification information 50*a* of command 50 and subsequently transmits command 50. In the example illustrated in FIG. 4, identification information 50*a* of command 50 received from radio remote controller 200 is rewritten from "000" to "001" that is an identifier assigned to relay 400. Command 50 including identification information 50*a* which has been rewritten and transmitted by relay transmitter 420 is received by command receiver 120 of lighting device B.

In this manner, command receiver 120 of lighting device B receives two commands 50 indicating the same instruction. However, the two commands 50 have the same command number "012", and thus lighting device B discards one of the two commands 50 which is received later.

In sum, lighting system 10 according to the embodiment performs the following method of communication. Radio remote controller 200 transmits command 50 including an instruction to lighting device 100 and a command number having a value varied every time command 50 is transmitted. Relay 400 wirelessly transmits command 50 received. Lighting device 100 receives command 50 transmitted by radio remote controller 200 or relay 400. If the command number included in a received command that is command 50 received does not match a command number stored in storage 130, lighting device 100 controls light source 110 according to the instruction included in the received command, and stores the command number included in the received command to storage 130. If the command number included in the received command matches the command number stored in storage 130, lighting device 100 discards the received command.

Figure 5:
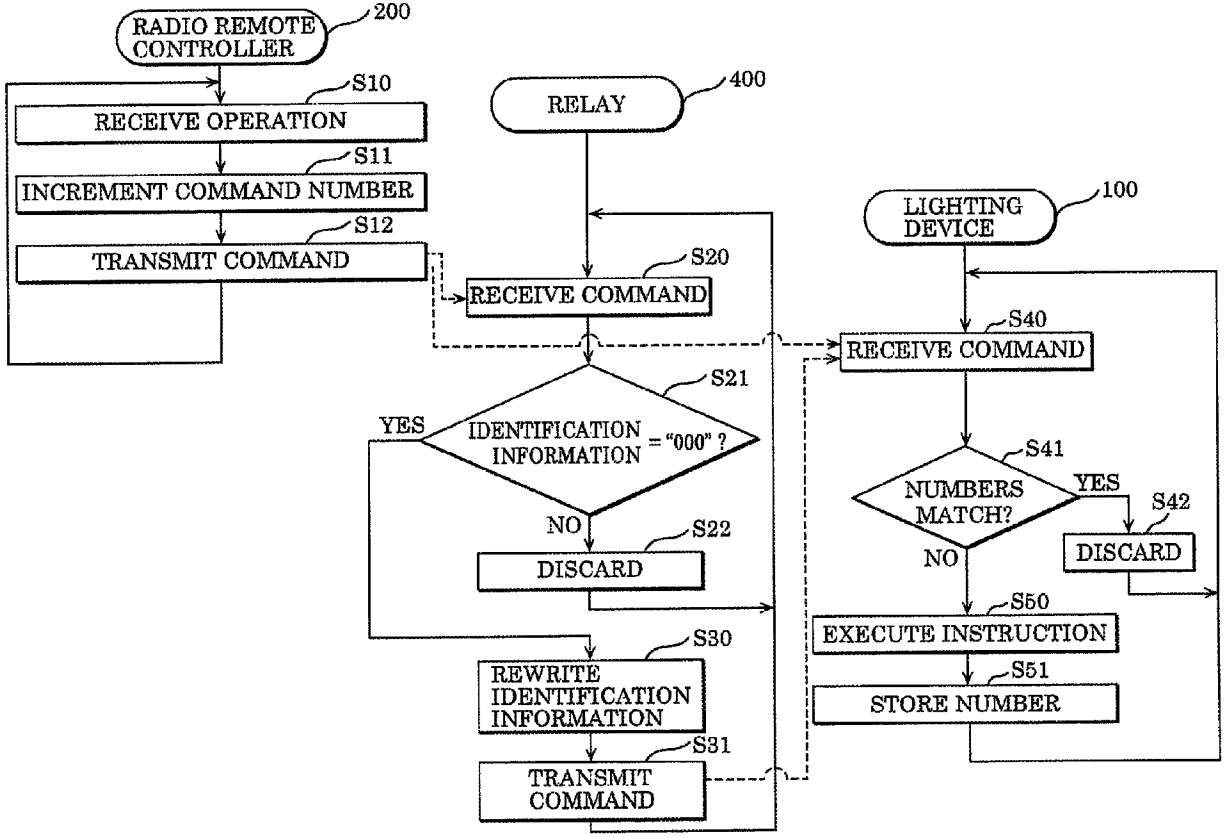
FIG. 5 is a flowchart illustrating an example of an operation flow of the lighting system according to the embodiment.

The following describes in more detail a specific example of the above-described operation, with reference to FIG. 5.

FIG. 5 is a flowchart illustrating an example of an operation flow of lighting system 10 according to the embodiment. It should be noted that, in the following example, the operation of lighting device 100 is described focusing on an operation of lighting device B (see FIG. 2 and FIG. 3), among lighting devices 100, which is placed in an environment where command 50 is redundantly received.

First, radio remote controller 200 receives a user's operation, for example, for controlling (e.g., changing a dimming ratio) lighting devices 100 (S10). Command transmitter 210 of radio remote controller 200 increments a command number when generating command 50 corresponding to this operation (S11).

More specifically, a command number (e.g., "011") of command 50 transmitted immediately before is stored in a recording medium such as a non-volatile memory (not illustrated) of radio remote controller 200, and command transmitter 210 generates a command number "012" by incrementing by one the command number stored in the recording medium.

Command transmitter 210 transmits command 50 including the command number "012" and an instruction corresponding to the above-described operation (e.g., "dimming ratio: 80%"). It should be noted that command 50 described above includes, for example, identifier "000" of radio remote controller 200 as identification information 50*a* as illustrated in FIG. 4.

Command receiver 120 of lighting device B receives command 50 transmitted by command transmitter 210, without involving relay 400 (S40). Control circuit 140 of lighting device B compares the command number "012" included in command 50 received by command receiver 120 (received command) with a command number stored in storage 130.

At this time, control circuit 140 of lighting device B has already performed control corresponding to command 50 to be executed (latest command 50) which command receiver 120 received last time, and command number "011" of latest command 50 is stored in storage 130.

Accordingly, the command number "012" included in the received command does not match the command number "011" stored in storage 130 (NO in S41). For that reason, control circuit 140 controls light source 110 according to the instruction included in the received command (S50). In this example, the dimming ratio is set to 80% as a result of the control performed on light source 110.

In addition, control circuit 140 stores the command number "012" to storage 130 (S51). At this time, the existing command number "011" may be rewritten to store a new command number "012", or the new command number "012" may be stored in storage 130 with the existing command number "011" remaining in storage 130 in a manner that the new command number "012" is identifiable as a latest command number. It should be noted that, when the command number is rewritten in storage 130, storage 130 may have a minimum storage capacity for storing only one command number.

In addition, storing of the command number (S51) may be performed in parallel with performing of the instruction (S50) or may be performed prior to performing of the instruction (S50).

In addition, in the above-described Step S12, command 50 transmitted by command transmitter 210 is also received by relay receiver 410 of relay 400 (S20). Relay transmitter 420 of relay 400 checks the identification information included in command 50 received by relay receiver 410. When the identification information included in command 50 does not match the identifier "000" of radio remote controller 200 as a result of the checking (NO in S21), relay 400 discards command 50 (S22). When another radio remote controller is disposed in the vicinity of lighting system 10, for example, relay 400 possibly receives command 50 transmitted by the another radio remote controller. However, relay 400 is capable of regarding only command 50 transmitted by radio remote controller 200 of lighting system as a target to be relayed, by checking the identification information included in command 50.

When the identification information included in command 50 matches the identifier "000" of radio remote controller 200 as a result of the above-described checking (YES in S21), relay transmitter 420 rewrites the identification information of command 50 (S30). In this example, the identification information of command 50 is rewritten from the identifier "000" of radio remote controller 200 to an identifier "001" assigned to relay 400. Command 50 having the rewritten identification information is transmitted by relay transmitter 420.

It should be noted that the identifier "000" of radio remote controller 200 is an example of first identification information, and the identifier "001" of relay 400 is an example of second identification information. More specifically, when the identification information included in command 50 received by relay receiver 410 is the first identification information ("000" in this example), relay transmitter 420 changes the identification information to the second identification information ("001" in this example) different from the first identification information, and subsequently transmits command 50. In addition, when the identification information included in command 50 received by relay receiver 410 is different from the first identification information ("000" in this example), relay transmitter 420 skips transmitting command 50.

In this manner, when transmitting command 50 received, relay 400 rewrites (changes) identification information of command 50 and transmits the identification information. With this, for example, command 50 transmitted by relay transmitter 420 is discarded even when command 50 is received by relay receiver 410 (S22). This suppresses loop of transmitting and receiving of command 50 by relay 400. Since communication loop of relay 400 is suppressed, for example, the reliability in operations of relaying command 50 by relay 400 is improved. This is advantageous in efficiently operating lighting device 100 in response to an instruction from radio remote controller 200.

Furthermore, assume the case where lighting system 10 includes a plurality of relays 400. In this case, even when one relay 400 receives command 50 transmitted by another relay 400, the one relay 400 discards command 50 received (S22). More specifically, relays 400 each change a value (information) of identification information of command 50 from "000" to a value different from "000" and transmit command 50 having the changed value, thereby suppressing communication loop of each of relays 400.

Here, in the above-described Step S31, command 50 transmitted by relay transmitter 420 is also received by command receiver 120 of lighting device B (S40). Moreover, there is a time lag of several tens of milliseconds, for example, between transmission of command 50 by radio remote controller 200 (S12) and transmission of command 50 by relay 400 (S31) in the above-described processing sequence.

For that reason, lighting device B starts to process command 50 transmitted by radio remote controller 200 and received without involving relay 400, prior to starting to process command 50 transmitted by relay 400. In other words, the latest command number "012" is stored in storage 130.

Accordingly, the command number "012" of command 50 transmitted by relay 400 and received by command receiver 120 matches the command number "012" stored in storage 130 (YES in S41). Accordingly, control circuit 140 discards command 50 (S42).

In this manner, lighting system 10 according to the embodiment includes relay 400 which receives and transmits command 50 transmitted by radio remote controller 200. In other words, in lighting system 10, redundancy is provided in a transmission path of an instruction transmitted from radio remote controller 200 to lighting device 100. With this, an instruction transmitted from radio remote controller 200 more reliably reaches lighting device 100 even when, for example, lighting device 100 is placed in an environment where it is difficult for radio waves from radio remote controller 200 to reach.

In addition, command 50 includes a command number, and command transmitter 210 of radio remote controller 200 varies the command number every time command 50 is transmitted. According to the embodiment, each command 50 includes a command number which is incremented by one every time command 50 is transmitted. Moreover, a command number of at least one command 50 that has been executed immediately before is stored in storage 130 of lighting device 100.

Accordingly, when control circuit 140 of lighting device 100 receives command 50, control circuit 140 compares a command number of command 50 received (received command) and a command number stored in storage 130, thereby determining whether or not to execute the received command. In other words, an instruction included in the received command has already been executed if the command number included in the received command matches the command number stored in storage 130, and thus the received command is discarded. This suppresses performing of an unnecessary process by lighting device 100 due to redundantly receiving commands indicating the same instruction.

Here, control circuit 140 is also capable of, for example, storing in storage 130 an instruction executed immediately before and comparing an instruction included in a received command and the instruction stored in storage 130, thereby determining whether or not to execute the instruction included in the received command.

However, a data size of the command number included in command 50 is smaller than a data size of the instruction included in command 50. For that reason, as described in the above-described embodiment, the storage capacity which is necessary for storage 130 is smaller when the latest command number is stored in storage 130 for later use in determining whether or not to execute an instruction than when an executed instruction is stored in storage 130 for later use in determining whether or not to execute an instruction. In addition, control circuit 140 compares command numbers each having a relatively small data size in determining whether or not to execute an instruction, and thus it is possible to determine whether or not to execute an instruction more efficiently than comparing two instructions themselves.

In this manner, lighting system 10 according to the embodiment is capable of causing lighting device 100 to efficiently operate according to an instruction from radio remote controller 200. Moreover, lighting device 100 according to the embodiment is capable of effectively operating according to an instruction from radio remote controller 200.

[Other Embodiments]

Although the lighting system according to the present disclosure has been described based on the above-described embodiment, the present disclosure is not limited to the above-described embodiment.

For example, lighting system 10 may include a plurality of relays 400.

Figure 6:
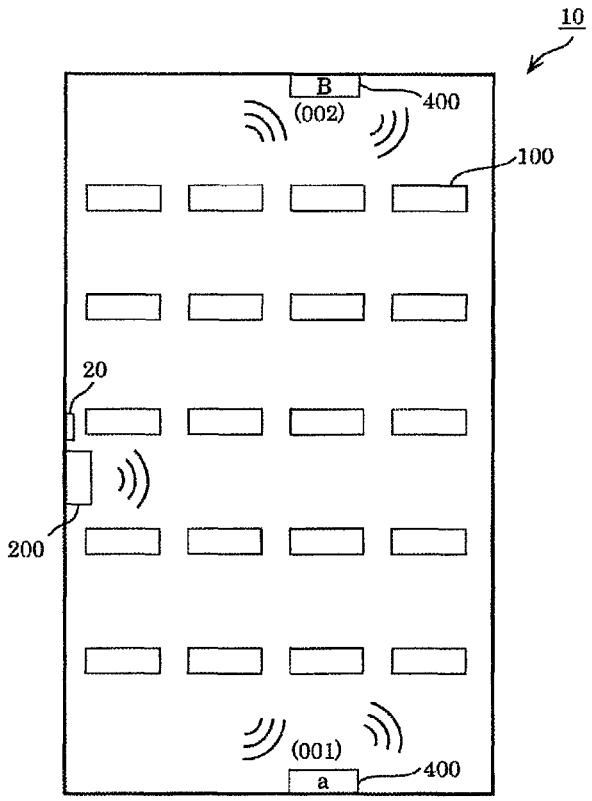
FIG. 6 is a plan view illustrating an example of the layout of the lighting system in the case where the lighting system includes a plurality of relays.

FIG. 6 is a plan view illustrating an example of the layout of lighting system 10 in the case where lighting system 10 includes a plurality of relays 400.

Lighting system 10 includes a plurality of relays 400 (two relays 400 in FIG. 6), and thus the redundancy increases in the transmission path of an instruction transmitted from radio remote controller 200 to lighting devices 100. For that reason, the instruction can further reliably reach lighting device 100. When a plurality of lighting devices 100 are scattered in places where it is difficult for radio waves from radio remote controller 200 to reach, for example, a plurality of relays 400 are disposed according to positions of the plurality of lighting devices 100. This improves credibility or reliability in collectively controlling the plurality of lighting devices 100 included in lighting system 10.

In addition, as described above, relays 400 each check identification information of command 50 received, for determining whether to transmit or discard command 50 received (S21 in FIG. 5). Moreover, relays 400 each rewrite identification information of command 50 when transmitting command 50 received (S30 in FIG. 5). For that reason, relays 400 each do not transmit command 50 even when receiving command 50 transmitted by itself or another relays 400 (S22). For that reason, loop of transmitting and receiving command 50 does not occur in each relay 400.

In addition, when relay transmitter 420 of each of relays 400 transmits command 50, relay transmitter 420 may change identification information included in command 50 to individual second identification information different among relays 400, and transmit command 50 having the individual second identification information.

Figure 7:
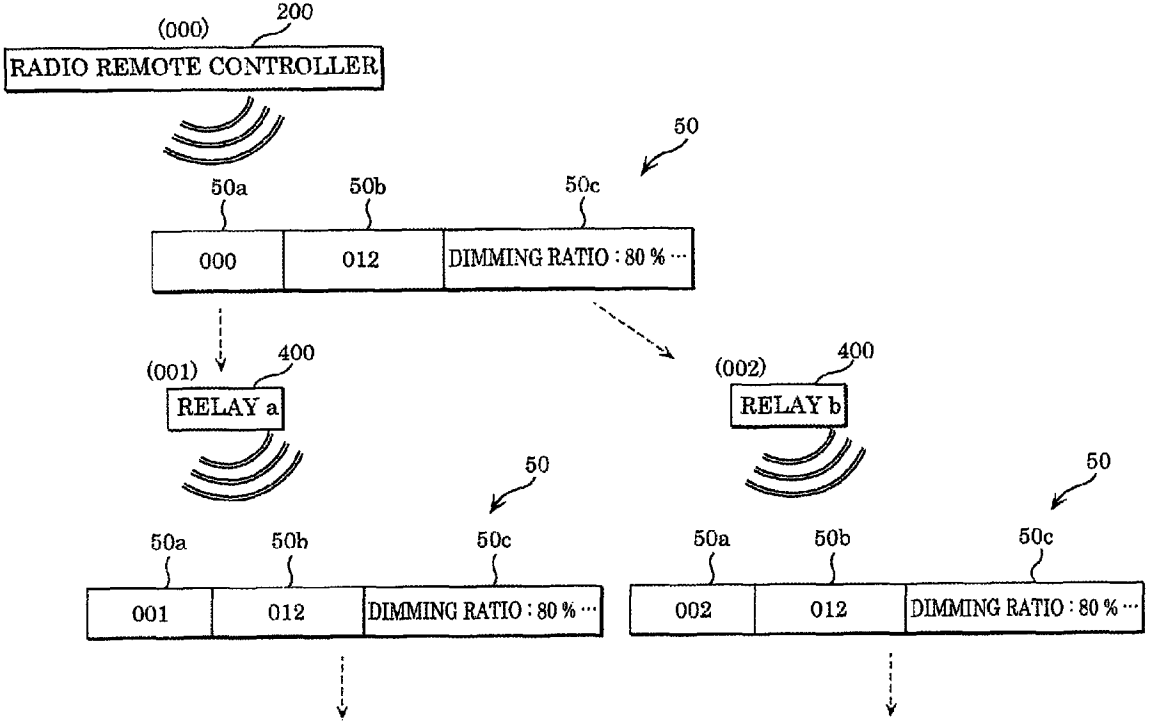
FIG. 7 is a diagram illustrating a data configuration example of a command in the case where the lighting system includes a plurality of relays.

FIG. 7 is a diagram illustrating a data configuration example of command 50 in the case where lighting system 10 includes a plurality of relays 400.

For example, assume the case where lighting system 10 includes relay a (relay 400 labeled as reference sign "a" in FIG. 6 and FIG. 7) and relay b (relay 400 labeled as reference sign "b" in FIG. 6 and FIG. 7).

In addition, assume the case where relay a is assigned with an identifier "001" and relay b is assigned with an identifier "002".

In this case, relay transmitter 420 of relay a rewrites identification information 50*a* of command 50 received by relay receiver 410 from the identifier "000" of radio remote controller 200 to the identifier "001" of relay a. In addition, relay transmitter 420 of relay b rewrites identification information 50*a* of command 50 received by relay receiver 410 from the identifier "000" of radio remote controller 200 to the identifier "002" of relay b.

In this manner, it is possible, for example, to check from which one of radio remote controller 200 and relays 400 each of lighting devices 100 included in lighting system 10 received and executed command 50.

More specifically, lighting devices 100 each stores in storage 130 identification information of the latest command 50. Accordingly, a communication device such as radio remote controller 200 is, by communicating with a plurality of lighting device 100, capable of checking from which one of radio remote controller 200 and relays 400 the plurality of lighting devices 100 receive and execute command 50.

In this manner, it is possible, for example, to analyze communication states such as validity of command 50 transmitted by each of relays 400 (whether or not command 50 is executed by at least one lighting device 100), and time-series change in the validity.

Here, relay receivers 410 of relays 400 concurrently (including substantially concurrently, same holds true for the description below) receive commands transmitted by radio remote controller 200. Accordingly, when not adjusting timing of transmitting commands from relays 400, relay transmitters 420 of relays 400 concurrently transmit commands. In this case, due to interference of radio waves from relays 400, for example, it is conceivable that the commands from relays 400 do not reach one or more lighting devices 100.

In view of the above, timing of transmitting commands from relays 400 may be adjusted for solving above-described defects. More specifically, when relay transmitters 420 of relays 400 transmit commands 50, relay transmitters 420 may transmit the command with timing different among relays 400.

For example, after receiving a command from radio remote controller 200, relays 400 may each wait for a period of time corresponding to the identifier assigned to the respective relays 400 and subsequently transmit the command.

For example, relay transmitter 420 of relay a transmits a command when wait time (e.g., 30 milliseconds) corresponding to the identifier "001" has elapsed since relay receiver 410 of relay a received the command. In addition, relay transmitter 420 of relay b transmits a command when wait time (e.g., 60 milliseconds) corresponding to the identifier "002" has elapsed since relay receiver 410 of relay b received the command. More specifically, relay transmitter 420 of each of relays 400 may calculate, as wait time, a period of time by multiplying a numerical value indicated by the identifier by a predetermined period of time (30 milliseconds in this example), and control timing of transmitting a command using the calculated wait time.

In this manner, command transmission timing is shifted among relays 400, and thus the possibility of the command reaching one or more lighting devices 100 increases.

In this case, relays 400 each transmit a command in ascending order of identifiers. Accordingly, for example, a user can adjust the command transmission timing of each of relays 400, by operating radio remote controller 200 to determine the identifier of each of relays 400. In addition, user may specify a variable not involving the identifier to shift the command transmission timing of each of relays 400.

Furthermore, after receiving a command from radio remote controller 200, each of relays 400 may wait for a period of time corresponding to a random number which each of relays 400 generated and subsequently transmit the command.

For example, relay transmitter 420 of each of relays 400 may control the command transmission timing by calculating, as wait time, a period of time by multiplying a value randomly selected from integers in a predetermined range (e.g., 30-180) by one millisecond and using the wait time calculated. This also substantially shifts the command transmission timing of each of relays 400. In this manner, the possibility of the command transmitted by each of relays 400 reaching one or more lighting devices 100 increases.

In addition, although lighting system 10 includes a plurality of lighting devices 100 in the above-described embodiment, lighting system 10 may include only one lighting device 100. For example, assume the case where the state of reaching of command 50 transmitted by radio remote controller 200 to one lighting device 100 included in lighting system 10 varies according to a time zone.

In this case, since lighting system 10 includes relay 400, it is possible to cause lighting device 100 to receive command 50 via relay 400 in a time zone when it is difficult for command 50 transmitted by radio remote controller 200 to directly reach lighting device 100. In a time zone when command 50 transmitted by radio remote controller 200 directly reaches lighting device 100, lighting device 100 redundantly receives commands 50 indicating the same instruction. However, as described above, lighting device 100 checks a command number of each command 50 (S41 in FIG. 5). For that reason, performing of an unnecessary process by lighting device 100 due to redundantly receiving command 50 is suppressed.

Furthermore, the command number generated by command transmitter 210 of radio remote controller 200 is not necessarily be a serial number which is incremented by one. The command number may be, for example, a serial number which is decremented by one every time command 50 is transmitted, or a random number generated every time command 50 is transmitted. In other words, it is sufficient that a command number included in one command 50 is different from a command number included in command 50 transmitted immediately before. More specifically, among a plurality of commands 50 transmitted at different time points, it is sufficient that command numbers are different between at least two adjacent commands 50 in chronological order of transmission. In this manner, lighting device 100 is capable of properly operating according to an instruction included in the at least two adjacent commands 50.

In addition, radio remote controller 200 need not transmit in real time command 50 according to an operation by a user. For example, radio remote controller 200 may transmit command 50 in response to an operation performed on radio remote controller 200 by a user or schedule information generated based on information transmitted via wired or wireless communication from another communication device to radio remote controller 200.

For example, by generating schedule information for changing a dimming ratio in each time zone, it is possible to automatically and collectively change brightness of plurality of lighting devices 100 using radio remote controller 200.

It should be noted that the present disclosure also includes other forms in which various modifications apparent to those skilled in the art are applied to the above-described embodiment and other embodiments or forms in which structural components and functions in the above-described embodiment and other embodiments are arbitrarily combined within the scope of the present invention.

While the foregoing has described what are considered to be the best mode and/or other examples, it is understood that various modifications may be made therein and that the subject matter disclosed herein may be implemented in various forms and examples, and that they may be applied in numerous applications, only some of which have been described herein. It is intended by the following claims to claim any and all modifications and variations that fall within the true scope of the present teachings.

What is claimed is:

1. A lighting system comprising:

a radio remote controller;

a relay; and a lighting device including a light source, wherein:

the radio remote controller includes a command transmitter which wirelessly transmits a command that includes an instruction to the lighting device and a command identifier having a value varied every time one command is transmitted, the relay includes a relay receiver which receives the command and a relay transmitter which wirelessly transmits, using radio waves, the command received by the relay receiver, and the lighting device further includes:

a command receiver for receiving the command transmitted by each of the command transmitter included in the radio remote controller and the relay transmitter included in the relay;

a storage; and a control circuit which (a) controls the light source according to the instruction included in a received command that is the command received by the command receiver and stores the command identifier included in the received command in the storage, when the command identifier included in the received command does not match a command identifier stored in the storage, and (b) discards the received command, when the command identifier included in the received command matches the command identifier stored in the storage.

2. The lighting system according to claim 1, wherein:

the command transmitted by the command transmitter further includes first identification information that is identification information of the radio remote controller, and (i) when identification information included in the command received by the relay receiver is the first identification information, the relay transmitter changes the identification information to second identification information different from the first identification information and transmits the command, and (ii) when the identification information included in the command received by the relay receiver is different from the first identification information, the relay transmitter skips transmission of the command.

3. The lighting system according to claim 2, wherein the lighting system comprises a plurality of relays each being configured to function as the relay, and when the relay transmitter of each of the plurality of relays transmits the command, the relay transmitter changes the identification information included in the command to individual second identification information and transmits the command, the individual second identification information being different among the plurality of relays.

4. The lighting system according to claim 3, wherein when the relay transmitter of each of the plurality of relays transmits the command, the relay transmitter of each of the plurality of relays transmits the command at a time point different among the plurality of relays.

5. The lighting system according to claim 1, wherein the command identifier included in the command transmitted by the command transmitter is smaller in data size than the instruction included in the command.

6. A lighting device comprising:

a light source;

a command receiver for receiving a command from each of a radio remote controller which wirelessly transmits the command using radio waves, and a relay which receives and transmits the command;

a storage; and a control circuit which (a) controls the light source according to an instruction included in a received command that is the command received by the command receiver and stores a command identifier included in the received command in the storage, when the command identifier included in the received command and having a value varied every time the radio remote controller transmits the command does not match a command identifier stored in the storage, and (b) discards the received command, when the command identifier included in the received command matches the command identifier stored in the storage.

7. A method of communication performed in a lighting system including a radio remote controller which wirelessly transmits a command, a relay, and a lighting device including a light source and a storage, the method comprising:

wirelessly transmitting, by the radio remote controller, the command that includes an instruction to the lighting device and a command identifier having a value varied every time one command is transmitted;

wirelessly transmitting using radio waves, by the relay, the command received from the radio remote controller; and (i) receiving, by the lighting device, the command transmitted by one of the radio remote controller and the relay, (ii) controlling, by the lighting device, the light source according to the instruction included in a received command that is the command received and storing the command identifier included in the received command into the storage, when the command identifier included in the received command does not match a command identifier stored in the storage, and (iii) discarding, by the lighting device, the received command, when the command identifier included in the received command matches the command identifier stored in the storage.

* * * * *